US006032882A

United States Patent [19]

Farahmand et al.

[11] Patent Number: 6,032,882

[45] Date of Patent: Mar. 7, 2000

[54] METHOD FOR CIRCULATION GRINDING OF BRITTLE GRINDING STOCK AND GRINDING APPARATUS THEREFOR

[75] Inventors: Akbar Farahmand, Cologne, Germany; Rene Klymowsky, Doorswerth, Netherlands

[73] Assignee: KHD Humboldt Wedag AG, Cologne, Germany

[21] Appl. No.: 09/145,079

[22] Filed: Sep. 1, 1998

[30] Foreign Application Priority Data

Sep. 2, 1997 [DE] Germany ..... 197 38 228

[51] Int. Cl.[7] ..... B02C 4/02

[52] U.S. Cl. ..... 241/24.13; 241/24.15; 241/27; 241/29; 241/79.1; 241/159; 241/227; 241/300

[58] Field of Search ..... 241/18, 19, 17, 241/24.13, 24.14, 24.15, 27, 29, 65, 79.1, 159, 227, 293, 300

[56] References Cited

U.S. PATENT DOCUMENTS

| | | | |
|---|---|---|---|
| 2,138,715 | 11/1938 | Thorsen | 241/97 |
| 4,134,556 | 1/1979 | Enrlich et al. | 241/79.3 |
| 4,703,897 | 11/1987 | Beisner et al. | 241/24 |
| 4,726,531 | 2/1988 | Strasser | 241/19 |
| 4,728,044 | 3/1988 | Duill et al. | 241/18 |
| 4,840,315 | 6/1989 | Rubin et al. | 241/24 |
| 4,905,910 | 3/1990 | Wuestner | 241/101.2 |
| 5,114,131 | 5/1992 | Strasser et al. | 241/19 |
| 5,165,613 | 11/1992 | Keller | 241/235 |
| 5,203,513 | 4/1993 | Keller et al. | 241/30 |
| 5,392,998 | 2/1995 | Suessegger et al. | 241/79.1 |

FOREIGN PATENT DOCUMENTS

| | | |
|---|---|---|
| 0 278 858 B1 | 4/1991 | European Pat. Off. . |
| 939 301 | 2/1956 | Germany . |
| 27 08 053 | 7/1979 | Germany . |
| 33 02 176 C2 | 5/1992 | Germany . |
| 35 18 543 | 3/1993 | Germany . |

*Primary Examiner*—John M. Husar
*Attorney, Agent, or Firm*—Hill & Simpson

[57] ABSTRACT

In order to enable grinding, with the lowest possible specific energy requirement, of brittle grinding material, in particular moist ores and/or other moist minerals, with the use of an interparticle crushing high-pressure roll press in which the roll surfaces are protected against wear by means of a grid armoring by an autogenous wear protection layer, without having to accept the risk of a premature damaging of the wear protection layer given the occurrence of rough particles/oversized particles/scattered particles, a smooth roll mill is connected upstream from the interparticle crushing high-pressure roll press, in whose nip (i.e. that of the smooth roll mill), the nip width is limited to a maximum of approximately 4 mm, such that only the oversized particles (scattered particles) contained in the feed material are coarse-crushed by means of individual particle crushing.

16 Claims, 1 Drawing Sheet

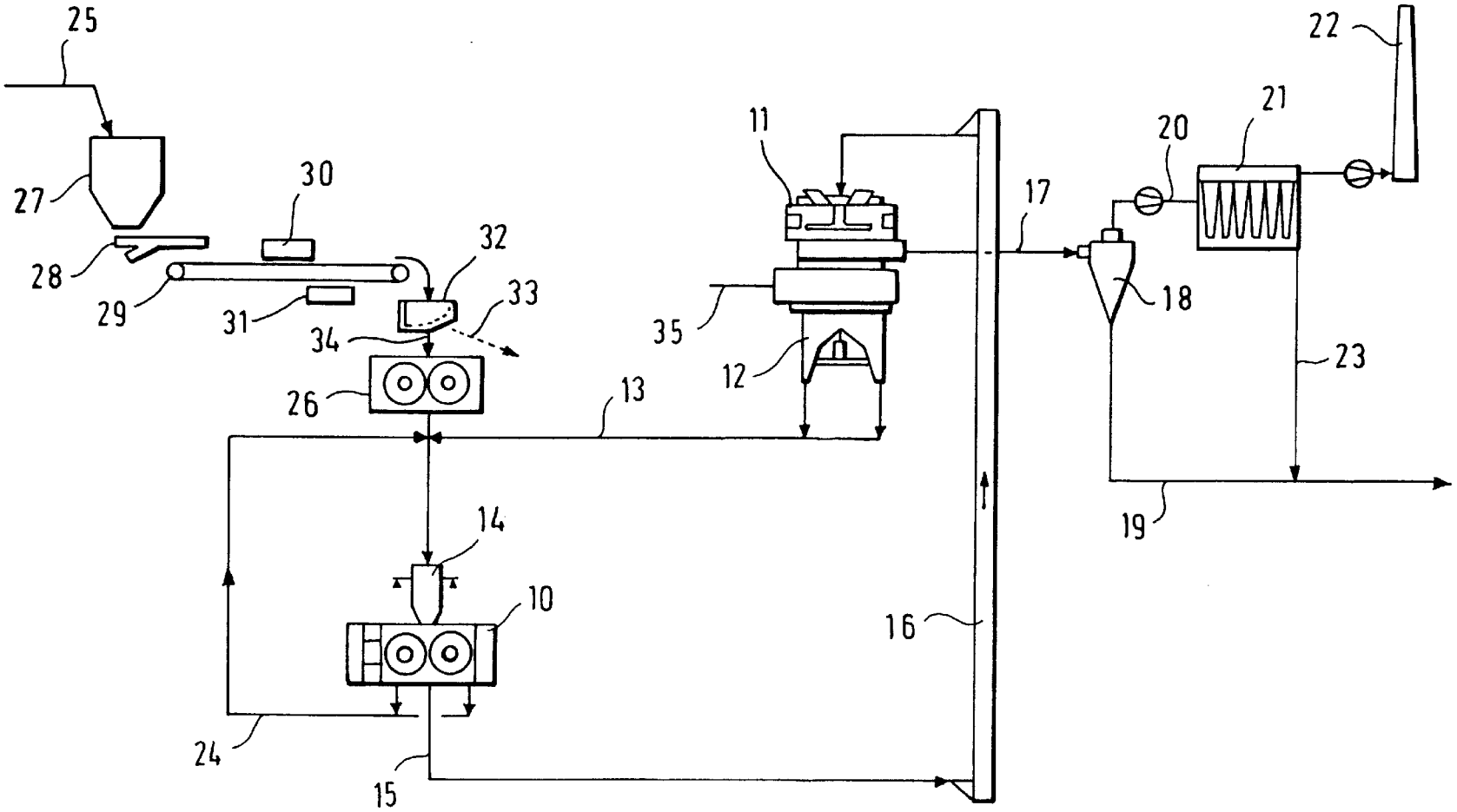
22
21
20
23
18
19
17
16
11
12
35
13
32
33
34
26
14
10
15
30
31
24
25
27
28
29

METHOD FOR CIRCULATION GRINDING OF BRITTLE GRINDING STOCK AND GRINDING APPARATUS THEREFOR

BACKGROUND OF THE INVENTION

The invention relates to a method for the circulation grinding of brittle grinding stock in the nip of an interparticle crushing high-pressure roll press with rolls, of which the nip width that arises during operation in the region of the narrowest nip is greater than the granular size of the grinding stock pressed there. Moreover, the invention relates to a grinding apparatus for carrying out the method.

In the pressure comminution of granular material in the nip of a high-pressure roll mill or, respectively, roll press, the bulk material supplied to the nip is seized by the rolls, which rotate in opposite directions, and is drawn into the nip by friction. The individual particles of the bulk material drawn in are thereby mutually crushed, grain against grain, in a bed of material, i.e., in a material grist pressed together between the two roll surfaces under the application of a high pressure. This arrangement is described as interparticle crushing and is disclosed in DE-C 27 08 053 (which disclosure is incorporated herein by reference). This pressure treatment or, respectively, material pressing produces material agglomerates made of comminuted bulk material which can subsequently be broken up or, respectively, disintegrated with a relatively low mechanical outlay, whereby the overall low specific energy requirement of the interparticle crushing results.

The energy savings is greatest in pure interparticle crushing. The granular size of the feed material must then be smaller than the nip width of the high-pressure roll press. Given coarse feed material, at least one coarse crushing machine is thus required, which comminutes the overall feed material to a granular size that is smaller than the nip width of the interparticle crushing roll mill. Thus, it is proposed for example in EP-B-0 278 858, FIG. 1, to connect a breaking mill provided with roll profiles upstream from a interparticle crushing roll mill, in which breaking mill the entire feed material is coarse-crushed. The upstream breaking mill can likewise be an interparticle crushing roll mill, in whose nip the overall bulk material supplied, i.e. also particles whose granular size is already sufficiently small, are comminuted, whereby the specific energy requirement of the overall milling process is however increased.

On the other hand, it is known to make the highly stressed roll surfaces of the interparticle crushing high-pressure roll mills or, respectively, roll presses more resistant to wear by means of what is known as a grid armoring, by attaching a multiplicity of pre-manufactured profile rails or pin-type nap bolts to the roll surface (EP-B-0 443 195 (U.S. Pat. No. 5,203,513), e.g. FIG. 4). The nap bolts thereby protrude outward from the roll surface with such a height, and are arranged with such a spacing from one another, that during operation of the roll press, the intermediate spaces or, respectively, pockets on the roll surface between the nap bolts remain filled with the pressed-together fine granular material, which forms an autogenous wear protection for the roll surfaces.

It is known that in the interparticle crushing, in particular of moist ores (moistness between approximately 2 and 10%), as they occur in practice, the adhesion or, respectively, the stability of the autogenous wear protection layer on the roll surface of the roll press provided with the grid armoring is not always ensured. It has thus already been proposed to use a binding agent to first attach a highly wear-resistant adhesive layer made of fine granular foreign material, such as e.g. silicon carbide, to the roll surfaces provided with the nap bolts, whereby during roll press operation the autogenous wear protection layer, e.g. the layer made of interparticle-crushed highly compressed ore agglomerates, can remain in adhesion to the rough surface of this adhesive layer. However, the service life of the autogenous wear protection layer, as well as of the radial inner adhesive layer, is endangered when an oversized particle or, respectively, scatter particle makes its way into the nip of the interparticle crushing high-pressure roll press, which, given an individual particle crushing (instead of interparticle crushing) in the nip of the roll press can lead to premature destruction of the autogenous wear protective layer, as well as of the adhesive layer located thereunder. This is also the case if, in an interparticle crushing roll press in whose narrowest nip region the interparticle crushing is carried out, an individual particle crushing were constantly carried out superposed thereon, in the upper additional nip region (DE-C 33 02 176 (U.S. Pat. No. 4,703,897), FIG. 1).

It would be disadvantageous and uneconomical to separate out existing rough particles/oversized particles/scattered particles from a moist granular mineral stream by means of a sieve classification, especially because the separated rough particles/oversized particles/scattered particles would then have to be ground separately.

SUMMARY OF THE INVENTION

The underlying object of the invention is to grind brittle grinding material, in particular moist ores and/or other moist minerals, with the use of an interparticle crushing high-pressure roll press, in which the roll surfaces are protected against wear by means of a grid armoring by an autogenous wear protection layer, with a specific energy requirement as low as possible, without having to accept the risk of a premature damaging of the wear protection layer given the occurrence of rough particles/oversized particles/scattered particles.

In the inventive grinding, in particular of moist ores or of other moist minerals, in the nip of an interparticle crushing high-pressure roll press, as well as with sifter and recirculation of the sifted raw material, the surfaces of the press rolls are protected against wear by means of a grid armoring by a wear protective layer that arises autogenously during press operation, whereby, for the better construction and for the more solid adhesion of the autogenous wear protection layer, underneath this layer an adhesive layer that is highly resistant to wear can be arranged, consisting of fine granular foreign material such as, for example, SiC and a binding agent. For the protection of this wear protection layer/protection layers against premature destruction, according to the invention a smooth roll mill is connected upstream from the interparticle crushing high-pressure roll press, in whose nip (i.e. that of the smooth roll mill), whose nip width is limited to a maximum of approximately 4 mm, not the entire feed material is coarse-crushed; rather, only the oversized particles (scattered particles) contained in the feed material that are larger than approximately 2 to 4 mm are coarse-crushed by individual particles. The smooth roll mill is thus used not as a standard coarse crushing machine, but rather only for the crushing of the oversized particles contained in the feed material, so that the energy requirement of the upstream smooth roll mill is not high.

In any case, in the nip of the interparticle crushing high-pressure roll press, an individual particle crushing, which is not desirable in the case of the equipping of the roll surfaces with an autogenous wear protection layer, is avoided with reliability according to the invention, whereby the service life of the roll surfaces of the roll press itself is increased considerably given interparticle crushing of moist ore material causing a high degree of wear.

At the same time, the upstream smooth roll mill promotes the interparticle crushing in the nip of the roll press, because, as experience has shown, the energy savings is greatest when the grinding stock has a smaller grain in comparison with the nip width. Moreover, according to the invention, high degrees of grinding fineness are achieved in grinding circulation with the interparticle crushing roll press and a high-performance sifter, at material circulation speeds that are not excessively high.

The inventive method is particularly suited for the grinding of moist material, such as for example for pigment grinding, grinding of pre-products for ore pellet production, etc.

The invention and additional features and advantages thereof are explained in more detail on the basis of the embodiment shown schematically in the drawing.

BRIEF DESCRIPTION OF THE DRAWING

The figure schematically illustrates the flow of materials through the apparatus of the invention.

DETAILED DESCRIPTION OF THE PREFERRED EMBODIMENTS

The drawing shows the flow diagram of a circulation grinding apparatus with a roll press 10 and with a de-agglomerator 11 and sifter 12 with recirculation of the sifting raw material 13 to the feeder shaft 14 of the roll press 10. In the operation of the interparticle crushing roll press 10, a narrowest nip with a nip width of e.g. approximately 12 to 35 mm arises, and in this nip the feed material, supplied via the feeder shaft 14, is pressed particle against particle with a press force of more than 2000 kN/m roll length to form material scabs 15, which are transported by the bucket conveyor 16 to the de-agglomerator 11, are broken up there, and are subsequently separated in the sifter 12, which is preferably a dynamic sifter, into sifted raw material 13 and sifted fine material 17, which is subsequently separated as finished material 19 by the sifter air stream 20 in a duct separator, such as, e.g., a cyclone 18, which air stream, after its de-dusting in a dust removal filter 21, is drawn off via a funnel 22. The dust discharge 23 from the dust removal filter 21 is added to the finished material 19.

A substream 24 of the material scabs leaving the roll press 10, in particular the possibly insufficiently pressed edge zones thereof exiting at the nip ends, is recirculated to the material feeder shaft 14 for the purpose of being stressed again in the material bed.

In order to increase the service life of the highly stressed surfaces of the rolls of the interparticle crushing high-pressure roll press 10, these roll surfaces are protected against premature wear by a grid armoring, i.e., a multiplicity of profile bodies, in particular nap bolts, is attached to the roll surfaces, with a height of approximately greater than 5 mm and with a spacing of approximately less than 40 mm, so that during operation of the roll press 10 the intermediate spaces or, respectively, pockets between the nap bolts are filled with pressed-together highly compressed fine granular material, whereby during the rotation of the rolls the pressed bodies remain in the pockets as an ideal autogenous roll wear protection. Such an arrangement is disclosed in U.S. Pat. No. 5,203,513, which disclosure is incorporated herein by reference. For the purpose of even more solid adhesion of the autogenous wear protection layer, a wear-resistant adhesive layer with a rough surface can be applied underneath it. Thus, such adhesive layer, consisting of a fine granular foreign material such as silicon carbide and a binding agent, can be applied directly to the roll surface prior to the autogenous wear protection layer being accumulated on the roll.

The feed material 25 of the grinding apparatus is in particular moist ore other moist materials with a moistness between approximately 2 to 10% which is already coarse-crushed, but contains a certain portion of oversized particles (scattered particles) comprising a granular size of, e.g., greater than 4 mm and which, should it move into the nip of the interparticle crushing roll press 10, can there prematurely destroy the autogenous wear protection layer thereof. Thus, a smooth roll mill 26 is connected upstream from the interparticle crushing high-pressure roll press 10, in whose nip (i.e., that of the smooth roll mill), whose nip width is limited to approximately 4 mm maximum, only the oversized particles contained in the feed material are coarse-crushed by means of individual particle crushing, while the remaining part of the feed material of the smooth roll press 26 is not crushed there, so that the specific energy requirement of the smooth roll mill 26 is comparatively low. The pressure force acting on the feed material in the smooth roll mill 26 is lower by approximately a power of 10 than that in the interparticle crushing roll press 10, so that the roll surfaces of the smooth roll mill 26 do not need to be protected against wear by means of a grid armoring.

While the circumferential speed of the rolls of the interparticle crushing roll press 10 is set to less than approximately 2.0 m/sec, the circumferential speed of the rolls of the upstream smooth roll mill 26 is set to greater than approximately 6.0 m/sec, whereby it also results that the smooth roll mill 26, which serves only for the pressure comminution of oversized particles, can be constructed comparatively small due to its high throughput.

It can also be seen from the drawing that the feed material 25 is deposited via a feed material bunker 27 and bunker outlet 28 on a feed strip 29 with a magnet 30, which removes magnetic foreign bodies from the feed material. In addition, a metal detection apparatus 31 can also be present that is able to emit a signal even given the presence of non-ferrous metals, such as for example stainless steel foreign bodies, that may be present in the feed material. Given a signal of the metal detection apparatus 31, a separating flap 32 is driven that transfers the signaled metals 33 out of the feed material, while the feed material 34, freed of metals, is supplied to the smooth roll mill 26.

With respect to the moistness of the feed material 25, the sifter 12 can be operated with hot gas 35 as a sifter air current, so that the sifter grits 13 recirculated to the interparticle crushing high-pressure roll press 11 are dried, whereby the operation of the roll press 10 is homogenized.

The underlying problem of the invention could not be solved by means of ajaw crusher, conical breaker, impact crusher/impact mill, roll crusher with breaking projections on the roll surfaces, roller mills, ball mills, vibration grinding mills, etc.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A method for circulation grinding of brittle grinding stock in a nip of an interparticle crushing high-pressure roll press, the outlet of which is connected to a sifter, from which separated sifted raw material is re-circulated back to a material inlet of said interparticle crushing high-pressure roll press, comprising the steps:

presenting a stream of coarse crushed brittle grinding stock, including some oversize particles, to a nip of a smooth roll press, wherein said smooth roll press nip has a smallest dimension of approximately 4 mm, for coarse-crushing said oversize particles by means of individual particle crushing and without interparticle crushing;

arranging said rolls of said interparticle crushing high-pressure roll press to form said nip therebetween with a width greater than a granular size of said grinding stock flowing from said smooth roil press, supplying said stream of brittle grinding stock, after it has passed through said nip of said smooth roll press, to said nip of said interparticle crushing high-pressure roll press;

protecting surfaces of said interparticle crushing press rolls against wear by an autogenous wear protection layer that arises during press operation, due to a grid armoring of said interparticle crushing press rolls.

2. The method according to claim 1, including setting a pressure force acting on the grinding stock in the interparticle crushing high-pressure roll press at more than 2000 kN/m roll length, while setting a pressure force acting on the feed material in the upstream smooth roll mill lower by a power of 10 than said pressure force in the interparticle crushing roll press.

3. The method of claim 1, including attaching a wear-resistant adhesive layer made of fine granular foreign material and a binding agent on an outer surface of said rolls of the interparticle crushing high-pressure roll press.

4. The method of claim 1, including flow connecting a sifter to an outlet of said interparticle crushing high pressure roll press, separating raw material and fine material in said sifter, and recirculating said raw material from said sifter back to a material inlet of said interparticle crushing high-pressure roll press.

5. The method of claim 4, including flow connecting a de-agglomerator upstream from said sifter.

6. The method of claim 4, including directing a flow of hot gas through said sifter to operate said sifter.

7. The method of claim 1, including recirculating a portion of material flowing from said interparticle high-pressure roll press back to said nip of said interparticle high-pressure roll press.

8. A method for circulation grinding of brittle grinding stock in a nip of an interparticle crushing high-pressure roll press, the outlet of which is connected to a sifter, from which separated sifted raw material is re-circulated back to a material inlet of said interparticle crushing high-pressure roll press, comprising the steps:

presenting a stream of coarse crushed brittle grinding stock, including some oversize particles, to a nip of a smooth roll press, wherein said smooth roll press nip has a smallest dimension of approximately 4 mm, for coarse-crushing said oversize particles by means of individual particle crushing and without interparticle crushing;

arranging said rolls of said interparticle crushing high-pressure roll press to form said nip therebetween with a width greater than a granular size of said grinding stock flowing from said smooth roll press, supplying said stream of brittle grinding stock, after it has passed through said nip of said smooth roll press, to said nip of said interparticle crushing high-pressure roll press;

protecting surfaces of said inter particle crushing press rolls against wear by an autogenous of proration layer that arises during press operation, due to a grid armoring of said interparticle crushing press rolls;

setting a circumferential speed of the rolls of the interparticles crushing high-pressure roll press to less than 2.0 m/sec., while setting a circumferential speed of the rolls of the upstream smooth roll press to greater than 6.0 m/sec.

9. A method for circulation grinding of brittle grinding stock in a nip of an interparticle crushing high-pressure roll press, the outlet of which is connected to a sifter, from which separated sifted raw material is re-circulated back to a material inlet of said interparticle crushing high-pressure roll press, comprising the steps:

presenting a steam of coarse crushed brittle grinding stock, including some oversize particles, to a nip of a smooth roll press, wherein said smooth roll press nip has a smallest dimension of approximately 4 mm, for coarse-crushing said oversize particles by means of individual particle crushing and without interparticle crushing;

arranging said rolls of said interparticle crushing high-pressure roll press to form said nip therebetween with a width greater than a granular size of said grinding stock flowing from said smooth roll press, supplying said stream of brittle grinding stock, after it has passed through said nip of said smooth roll press, to said nip of said interparticle crushing high-pressure roll press;

protecting surfaces of said interparticle crushing press rolls against wear by an autogenous wear protection layer that arises during press operation, due to a grid armoring of said interparticle crushing press rolls;

removing metal material from said stream of coarse crushed brittle stock before it is presented to said smooth roll press.

10. A circulation grinding apparatus for the grinding of brittle material, comprising the combination of a delivery system for supplying a stream of coarse crushed brittle grinding stock including some oversize particles;

a smooth roll press having opposed rolls forming a nip therebetween with a smallest dimension of approximately 4 mm, for receiving said stream of coarse crushed brittle grinding stock, for coarse crushing said oversize particles by means of individual particle crushing and without interparticle crushing, said smooth roll press having a material outlet;

an interparticle crushing high-pressure roll press having opposed rolls forming a nip therebetween with a smallest dimension greater than a granular size of said grinding stock flowing from said smooth roll press, and having a material inlet connected to said material outlet;

said rolls of said interparticle crushing high-pressure roll press comprising a grid armoring with an autogenous wear protection layer; and a sifter flow connected to an outlet of said interparticle crushing high-pressure roll press for separating raw material and fine material and for recirculating said raw material back to said material inlet of said interparticle crushing high-pressure roll press.

11. The circulation grinding apparatus according to claim 10, including a wear-resistant adhesive layer made of fine granular foreign material and a binding agent attached on an outer surface of said rolls of the interparticle crushing high-pressure roll press.

12. The circulation grinding apparatus according to claim 10, including a de-agglomerator connected upstream from said sifter.

13. The circulation grinding apparatus according to claim 10, wherein said sifter is operated with hot gas.

14. The circulation grinding apparatus according to claim 10, including a recirculating apparatus connected to an outlet of said interparticle crushing high-pressure roll press for recirculating a portion of the material flowing from said interparticle crushing high-pressure roll press back to said material inlet.

15. A circulation grinding apparatus for the grinding of brittle material, comprising the combination of a delivery system for supplying a stream of coarse crushed brittle grinding stock including some oversize particles;

a smooth roll press having opposed rolls forming a nip therebetween with a smallest dimension of approximately 4 mm, for receiving said stream of coarse crushed brittle grinding stock, for coarse crushing said oversize particles by means of individual particle crushing and without interparticle crushing, said smooth roll press having a material outlet;

an interparticle crushing high-pressure roll press having opposed rolls forming a nip therebetween with a smallest dimension greater than a granular size of said grinding stock flowing from said smooth roll press, and having a material inlet connected to said material outlet;

said rolls of said interparticle clashing high-pressure roll press comprising a grid armoring with an autogenous wear protection layer; and a sifter flow connected to an outlet of said interparticle crushing high-pressure roll press for separating raw material and fine material and for recirculating said raw material back to said material inlet of said interparticle crushing high-pressure roll press said delivery system including a feed material bunker and a device for removing metal material from said stream of coarse crushed brittle grinding stock.

16. The circulation grinding apparatus according to claim 15, including a magnet for removing ferrous materials.

* * * * *